US006732701B2

(12) United States Patent
Bonde et al.

(10) Patent No.: US 6,732,701 B2
(45) Date of Patent: May 11, 2004

(54) OIL CIRCUIT FOR TWIN CAM INTERNAL COMBUSTION ENGINE

(75) Inventors: Kevin G. Bonde, Kiel, WI (US); Terrence M. Rotter, Sheboygan Falls, WI (US); Robert W. Richards, Sheboygan, WI (US); William D. Koenigs, Fond du Lac, WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 10/188,131

(22) Filed: Jul. 1, 2002

(65) Prior Publication Data

US 2004/0000285 A1 Jan. 1, 2004

(51) Int. Cl.[7] ..... F01M 1/00
(52) U.S. Cl. ..... 123/196 R
(58) Field of Search ..... 123/90.33, 90.34, 123/90.6, 90.61, 196 R, 198 C, 196 W; 184/6.2, 6.5

(56) References Cited

U.S. PATENT DOCUMENTS

| | | | |
|---|---|---|---|
| 1,172,612 | A | 2/1916 | Kremer |
| 1,301,007 | A | 4/1919 | Roof |
| 1,410,019 | A | 3/1922 | Krause |
| 1,469,063 | A | 9/1923 | Wills |
| 1,590,073 | A | 6/1926 | Birkigt |
| 1,684,955 | A | 9/1928 | Goodwin |
| 2,235,160 | A | 3/1941 | Ljungstrom |
| 2,459,594 | A | 1/1949 | Smith |
| 3,118,433 | A | 1/1964 | Lechtenberg |

(List continued on next page.)

FOREIGN PATENT DOCUMENTS

| | | | |
|---|---|---|---|
| DE | 3120190 | A1 | 5/1982 |
| WO | WO 86/04122 | A1 | 7/1986 |
| WO | WO 00/43655 | A1 | 7/2000 |

OTHER PUBLICATIONS

"Technical Innovations—Briggs & Stratton extends engine life", SAE Off–Highway Engineering, Oct. 2001, p. 4.
3 undated photographs of Briggs & Stratton balance system, admitted prior art.
Marketing literature concerning Briggs & Stratton AVS system, 2001 (2 pages).
Notes and photographs concerning Balance System of Briggs & Stratton shown at Louisville trade show in Jul., 2001 (3 pages of notes, 2 pages of photographs).
Information concerning gerators, obtained at www.vianenterprises.com, printed Mar. 2, 2002 (4 pages.).
Information concerning crescent pumps, obtained at www-.animatedsoftware.com, printed Jul. 2, 2001 (1 page).
"Gerotor Lubricating Oil Pump for IC Engines", S. Manco et al., SAE Intn'l FL98 (San Francisco) (17 pages).
Undated photographs of Kohler Command–Single Automatic Compression Release mechanism, admitted prior art (1 page).
Undated photographs of Briggs & Stratton Automatic Compression Release mechanism, admitted prior art (1 page).
Undated photographs of Honda OHC Automatic Compression Release mechanism and cam follower, admitted prior art (3 pages).

*Primary Examiner*—Terry M. Argenbright
*Assistant Examiner*—Hyder Ali
(74) *Attorney, Agent, or Firm*—Quarles & Brady LLP

(57) ABSTRACT

An internal combustion engine, and method of distributing lubricant within an internal combustion engine, are disclosed. The internal combustion engine includes a crankcase having a floor, a pump supported by the floor, and a camshaft. The pump includes an inlet and an outlet. The camshaft has a cam, first and second camshaft ends, and an internal channel extending within the camshaft between the ends. The first end is supported by the pump or the floor. Rotation of the camshaft causes the pump to draw in lubricant via the inlet and to pump out at least some of the lubricant via the outlet. The outlet is positioned in proximity to the internal channel at the first camshaft end, so that at least some of the lubricant is pumped into the channel.

23 Claims, 10 Drawing Sheets

U.S. PATENT DOCUMENTS 3,195,526 A 7/1965 Jordan
3,200,804 A 8/1965 Hensler et al.
3,314,408 A 4/1967 Fenton
3,407,741 A 10/1968 Weber et al.
3,457,804 A 7/1969 Harkness
3,561,416 A 2/1971 Kiekhaefer
3,751,080 A 8/1973 Bailey et al.
3,818,577 A 6/1974 Bailey et al.
4,030,179 A 6/1977 Schwarz
4,097,702 A 6/1978 Halsted
4,185,717 A 1/1980 Ford, Jr. et al.
4,198,879 A 4/1980 Hornak et al.
4,283,607 A 8/1981 Brightman
4,285,309 A 8/1981 Johansson
4,308,830 A 1/1982 Yamada et al.
4,332,222 A 6/1982 Papez
4,336,777 A 6/1982 Yanagihara et al.
4,366,787 A 1/1983 Gale
4,372,258 A 2/1983 Iwai
4,380,216 A 4/1983 Kandler
4,391,231 A 7/1983 TateBe et al.
4,401,067 A 8/1983 Honda
4,414,934 A 11/1983 Vogl et al.
4,422,348 A 12/1983 Campbell
4,433,651 A 2/1984 Nakakita et al.
4,446,828 A 5/1984 Bauder et al.
4,452,194 A 6/1984 Watanabe
4,458,555 A 7/1984 Holtzberg et al.
4,507,917 A 4/1985 Kandler
4,510,897 A 4/1985 Hatz et al.
4,530,318 A 7/1985 Semple
4,534,241 A 8/1985 Remmerfelt et al.
4,548,253 A 10/1985 Funatani et al.
4,569,109 A 2/1986 Fetouh
4,570,584 A 2/1986 Uetsuji et al.
4,617,122 A 10/1986 Kruse et al.
4,622,933 A 11/1986 Fukuo et al.
4,644,912 A 2/1987 Umeha et al.
4,656,981 A 4/1987 Murata et al.
4,660,512 A 4/1987 Binder et al.
4,672,930 A 6/1987 Sumi
4,674,455 A 6/1987 Tsuboi
4,684,267 A 8/1987 Fetouh
4,688,446 A 8/1987 Ishikawa
4,691,590 A 9/1987 Geringer et al.
4,696,266 A 9/1987 Harada
4,711,823 A 12/1987 Shiina
4,736,717 A 4/1988 Fujikawa et al.
4,793,297 A 12/1988 Fujii et al.
4,802,269 A 2/1989 Mukai et al.
4,819,592 A 4/1989 van Ligten
4,819,593 A 4/1989 Bruener et al.
4,822,414 A 4/1989 Yoshikawa et al.
4,828,632 A 5/1989 Adam et al.
4,834,784 A 5/1989 Bidanset
4,836,045 A 6/1989 Lobig
4,838,909 A 6/1989 Bidanset
4,853,179 A 8/1989 Shiina
4,867,806 A 9/1989 Shiina
4,892,068 A 1/1990 Coughlin
4,898,133 A 2/1990 Bader
4,909,197 A 3/1990 Perr
4,926,814 A 5/1990 Bonde
4,928,550 A 5/1990 Sakai et al.
4,934,442 A 6/1990 Futamura et al.
4,949,687 A 8/1990 Emmersberger
4,958,537 A 9/1990 Diehl et al.
4,964,378 A 10/1990 Tamba et al.
4,986,224 A 1/1991 Zuffi
5,002,023 A 3/1991 Butterfield et al.
5,038,727 A 8/1991 Burns et al.
5,057,274 A 10/1991 Futamura et al.
5,085,184 A 2/1992 Yamada et al.
5,152,264 A 10/1992 Evans
5,163,341 A 11/1992 Murrish et al.
5,197,422 A 3/1993 Oleksy et al.
5,197,425 A 3/1993 Santi
5,207,120 A 5/1993 Arnold et al.
5,241,873 A 9/1993 Hormann
5,243,878 A 9/1993 Santi
5,265,700 A 11/1993 Santi
5,282,397 A 2/1994 Harkness et al.
5,323,745 A 6/1994 Sato et al.
5,357,917 A 10/1994 Everts
5,370,093 A 12/1994 Hayes
5,375,571 A 12/1994 Diehl et al.
5,421,297 A 6/1995 Tamba et al.
5,463,809 A 11/1995 Hoffman et al.
5,497,735 A 3/1996 Kern et al.
5,524,581 A * 6/1996 Rush et al. ..... 123/90.34
5,555,776 A 9/1996 Gazza
5,556,441 A 9/1996 Courtwright et al.
5,560,333 A 10/1996 Genouille
5,615,586 A 4/1997 Phillips et al.
5,651,336 A 7/1997 Rygiel et al.
5,711,264 A 1/1998 Jezek et al.
5,809,958 A 9/1998 Gracyalny
5,823,153 A 10/1998 Santi et al.
5,863,424 A 1/1999 Lee
5,887,678 A 3/1999 Lavender
5,904,124 A 5/1999 Poehlman et al.
5,964,198 A 10/1999 Wu
5,979,392 A 11/1999 Moorman et al.
5,988,135 A 11/1999 Moorman et al.
6,006,721 A 12/1999 Shannon et al.
6,047,667 A 4/2000 Leppanen et al.
6,055,952 A 5/2000 Gau
6,076,426 A 6/2000 Genouille
6,109,230 A 8/2000 Watanabe et al.
6,116,205 A 9/2000 Troxler et al.
6,126,499 A 10/2000 Katayama et al.
6,170,449 B1 1/2001 Saiki et al.
6,213,081 B1 4/2001 Ryu et al.
6,269,786 B1 8/2001 Snyder et al.
6,293,981 B1 9/2001 Holderle et al.
6,395,049 B2 5/2002 Knodler et al.
6,460,504 B1 * 10/2002 Phillips et al. ..... 123/196 R

* cited by examiner

OIL CIRCUIT FOR TWIN CAM INTERNAL COMBUSTION ENGINE

FIELD OF THE INVENTION

The present invention relates to internal combustion engines, particularly single cylinder internal combustion engines such as those used to power lawnmowers, sump pumps, portable generators and other devices. More specifically, the present invention relates to a twin cam design and related oil circuit for implementation in such engines.

BACKGROUND OF THE INVENTION

Single cylinder internal combustion engines typically employ an intake valve and an exhaust valve for allowing fuel and air to enter the engine cylinder and allowing exhaust to exit the cylinder, respectively. These valves often are actuated by way of valve trains that impart linear movement to the valves in response to rotational movement of cams. In many such engines, the intake and exhaust valves are actuated in one direction (to close) by respective springs and actuated in the opposite direction (to open) by respective rocker arms. The rocker arms in turn are actuated by respective push rods that ride along respective cams that are supported by and rotate about a camshaft, which in turn is driven by a crankshaft of the engine. A fan also driven by the crankshaft blows air across the cylinder to cool the cylinder.

In such engines, it is important that oil or other lubrication be provided to at least the main bearings for the crankshaft and the camshaft, and that such oil be filtered. Consequently, most single cylinder engines also have carefully-designed lubrication systems to provide the necessary lubrication. The lubrication systems typically include an oil reservoir, a pump, and an oil circuit consisting of a series of passages by which oil is directed from the pump to the oil filter and to the components requiring lubrication. The oil passages are commonly manufactured by drilling or casting tubes into the crankcase and cover/oil pan of the engine.

Single cylinder engines of this design have several limitations. To begin with, the push rods that are positioned on such engines in between the camshaft and the rocker arms are positioned close together on a single side of the cylinder. Likewise, the pair of rocker arms at the cylinder head are positioned close together along a single side of the cylinder head, as are the pair of valves. Consequently, the valve bridge area of the cylinder head in between the valves, which is the hottest area of the cylinder head, is narrow and partially shielded from air being blown across the cylinder head by the fan. As a result, the valve bridge area may not be cooled as well as might be desirable, which can eventually cause weakening or breakage of the cylinder head, or to distortion/movement of the valve seats adjacent to this valve bridge area.

Additionally, the oil circuits in such single cylinder engines are often complicated in design and expensive to manufacture. In particular, the drilling or casting that is required in order to provide the required oil passages within the crankcase walls and cover/oil pan can be expensive and difficult to manufacture. The casting of tubular passages in particular is expensive insofar as it requires the use of cores.

Further, given their complexity and large number of moving parts, the valve trains (including the camshaft and crankshaft) of such engines also can be difficult and costly to design and manufacture. For example, the two cams on a camshaft of such an engine typically must be oriented differently so that their respective main cam lobes are 100 or more degrees apart. Consequently, the manufacture of a camshaft with two such differently-oriented cams can be difficult and expensive, particularly when it is desired to integrally form the camshaft and cams as a single part. The costs of manufacturing of such valve train components can be further exacerbated if it is desired to manufacture such components from materials that are more durable or that provide quieter operation, since it is typically more difficult to mold or machine complex parts from such materials.

It would therefore be advantageous if a new single cylinder engine was designed that avoided or suffered less from the above problems. In particular, it would be advantageous if a single cylinder engine with robust, quietly-operating components could be designed that was more easily and cost-effectively manufactured than conventional engines, particularly in terms of the costs associated with the components of its valve train and lubrication system. Further, it would be advantageous if a single cylinder engine could be designed in which there was more effective cooling of the valve bridge area than in conventional engines.

SUMMARY OF THE INVENTION

The present inventors have discovered a new, twin-cam single cylinder engine design having two camshafts that are each driven by the crankshaft. Because two camshafts are employed, one of which drives a valve train for an intake valve and one of which drives a valve train for an exhaust valve, the valves are respectively positioned on opposite sides of the cylinder so that the valve bridge area is exposed to allow for more effective cooling of that area. Each of the twin camshafts includes a respective internal passage extending the length of the respective camshaft. One of the camshafts is supported by an oil pump. Rotation of that camshaft drives the pump, causing oil to be pumped toward a lower bearing of the crankshaft and also up through the internal passage in that camshaft.

The oil is then directed through molded passages within a top of the crankcase, to an oil filter, to an upper bearing of the crankshaft, and to the other camshaft. It further flows through the internal passage of that other camshaft to the lower bearing of that camshaft. The passages within the top of the crankcase are formed by molding grooves in the top and covering those grooves with an additional plate. Because twin camshafts are employed, each of which has only a single cam lobe, the camshafts can more easily be manufactured from robust, quietly-operating materials. Additionally, by employing the passages within the top of the crankcase and within the camshafts, manufacture of the crankshaft oil circuit is simpler and more cost-effective than in conventional engine designs.

In particular, the present invention relates to an internal combustion engine including a crankcase having a floor, a pump supported by the floor of the crankcase, and a first camshaft. The pump includes an inlet and a first outlet. The first camshaft has a first cam, first and second camshaft ends, and a first internal channel extending within the first camshaft between the first and second camshaft ends. The first camshaft end is supported by one of the pump and the floor. Rotation of the first camshaft causes the pump to draw in lubricant via the inlet and to pump out at least a first portion of the lubricant via the first outlet. The first outlet is positioned in proximity to the first internal channel at the first camshaft end, so that at least some of the first portion of the lubricant pumped out via the first outlet is pumped into the first internal channel.

The present invention further relates to an internal combustion engine including means for converting rotational motion imparted by a crankshaft into linear motion used to actuate a valve. The internal combustion engine additionally includes means for pumping lubricant, and means for communicating the lubricant through at least a portion of the means for converting. The means for pumping is actuated by the means for converting, and the means for pumping pumps the lubricant into the means for communicating so that the lubricant is provided to a component requiring the lubricant.

The present invention additionally relates to a method of distributing lubricant within an internal combustion engine. The method includes providing a crankshaft, a first camshaft having an internal channel extending between first and second ends of the first camshaft, a pump having an inlet and an outlet, and a first bearing for the first end of the first camshaft, where the outlet is proximate the first bearing and the internal channel at the first end of the first camshaft. The method further includes rotating the crankshaft, imparting rotational motion from the crankshaft to the first camshaft, and imparting additional rotational motion from the first camshaft to at least a portion of the pump. The method additionally includes pumping the lubricant from the inlet of the pump to the outlet of the pump as a result of the additional rotational motion, so that a first portion of the lubricant is provided to the first bearing and a second portion of the lubricant is pumped into the internal channel at the first end of the first camshaft so that the lubricant is communicated through the internal channel to the second end of the first camshaft.

DETAILED DESCRIPTION OF THE PREFERRED EMBODIMENT

Figure 1:
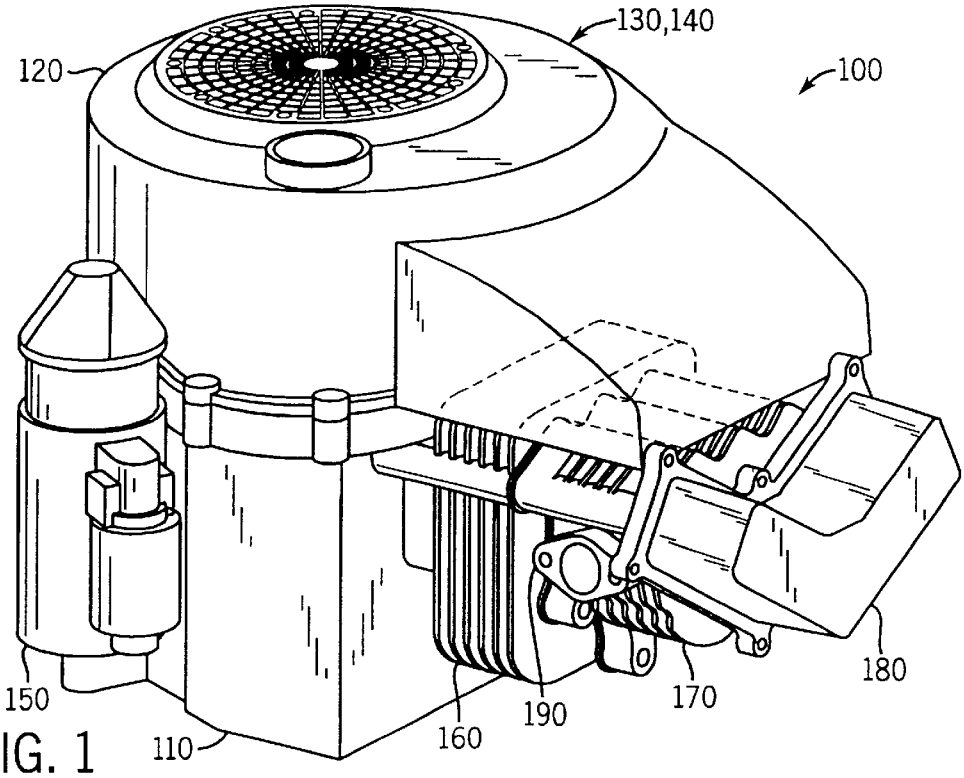
FIG. 1 is a first perspective view of a single cylinder engine, taken from a side of the engine on which are located a starter and cylinder head.
Figure 2:
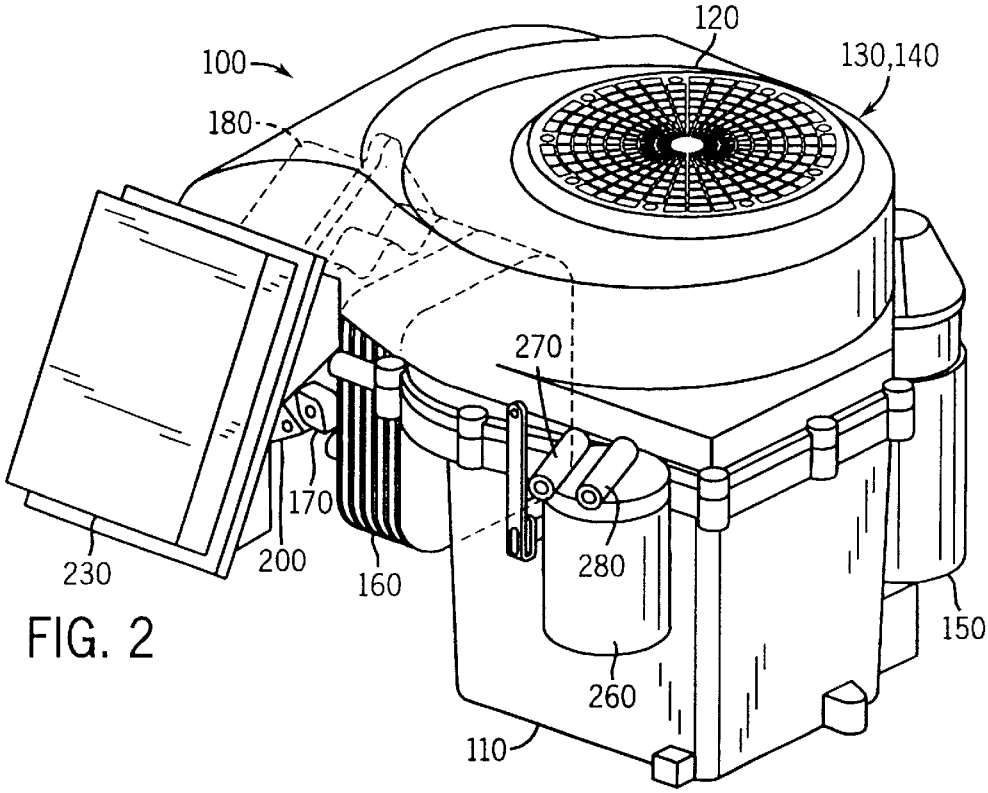
FIG. 2 is a second perspective view of the single cylinder engine of FIG. 1, taken from a side of the engine on which are located an air cleaner and oil filter.

Referring to FIGS. 1 and 2, a new single cylinder, 4-stroke, internal combustion engine 100 designed by Kohler Co. of Kohler, Wis. includes a crankcase 110 and a blower housing 120, inside of which are a fan 130 and a flywheel 140. The engine 100 further includes a starter 150, a cylinder 160, a cylinder head 170, and a rocker arm cover 180. Attached to the cylinder head 170 are an air exhaust port 190 shown in FIG. 1 and an air intake port 200 shown in FIG. 2. As is well known in the art, during operation of the engine 100, a piston 210 (see FIG. 7) moves back and forth within the cylinder 160 towards and away from the cylinder head 170. The movement of the piston 210 in turn causes rotation of a crankshaft 220 (see FIG. 7), as well as rotation of the fan 130 and the flywheel 140, which are coupled to the crankshaft. The rotation of the fan 130 cools the engine, and the rotation of the flywheel 140, causes a relatively constant rotational momentum to be maintained.

Referring specifically to FIG. 2, the engine 100 further includes an air filter 230 coupled to the air intake port 200, which filters the air required by the engine prior to the providing of the air to the cylinder head 170. The air provided to the air intake port 200 is communicated into the cylinder 160 by way of the cylinder head 170, and exits the engine by flowing from the cylinder through the cylinder head and then out of the air exhaust port 190. The inflow and outflow of air into and out of the cylinder 160 by way of the cylinder head 170 is governed by an input valve 240 and an output valve 250, respectively (see FIG. 8). Also as shown in FIG. 2, the engine 100 includes an oil filter 260 through which the oil of the engine 100 is passed and filtered. Specifically, the oil filter 260 is coupled to the crankcase 110 by way of incoming and outgoing lines 270, 280, respectively, whereby pressurized oil is provided into the oil filter and then is returned from the oil filter to the crankcase.

Figure 3:
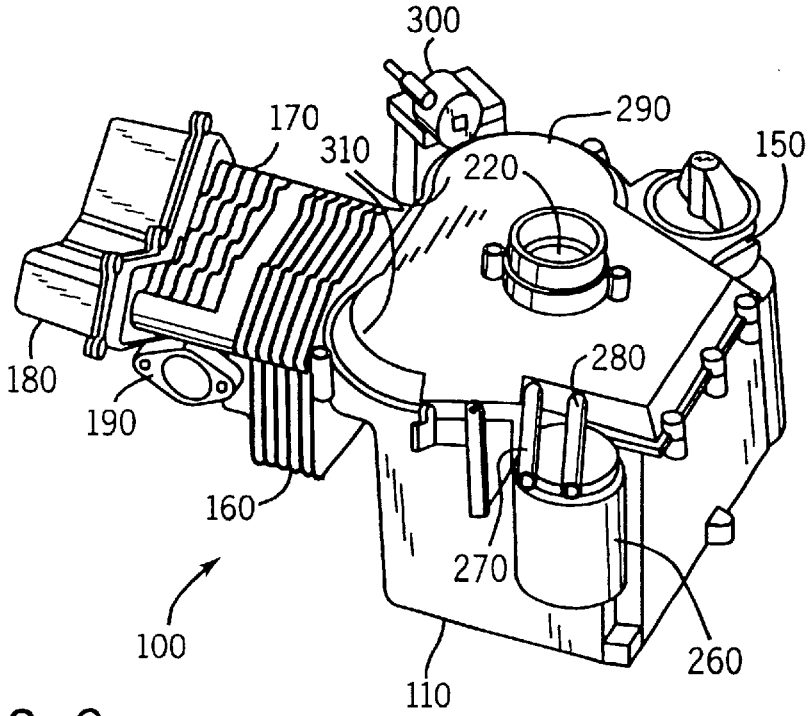
FIG. 3 is a third perspective view of the single cylinder engine of FIG. 1, in which certain parts of the engine have been removed to reveal additional internal parts of the engine.
Figure 4:
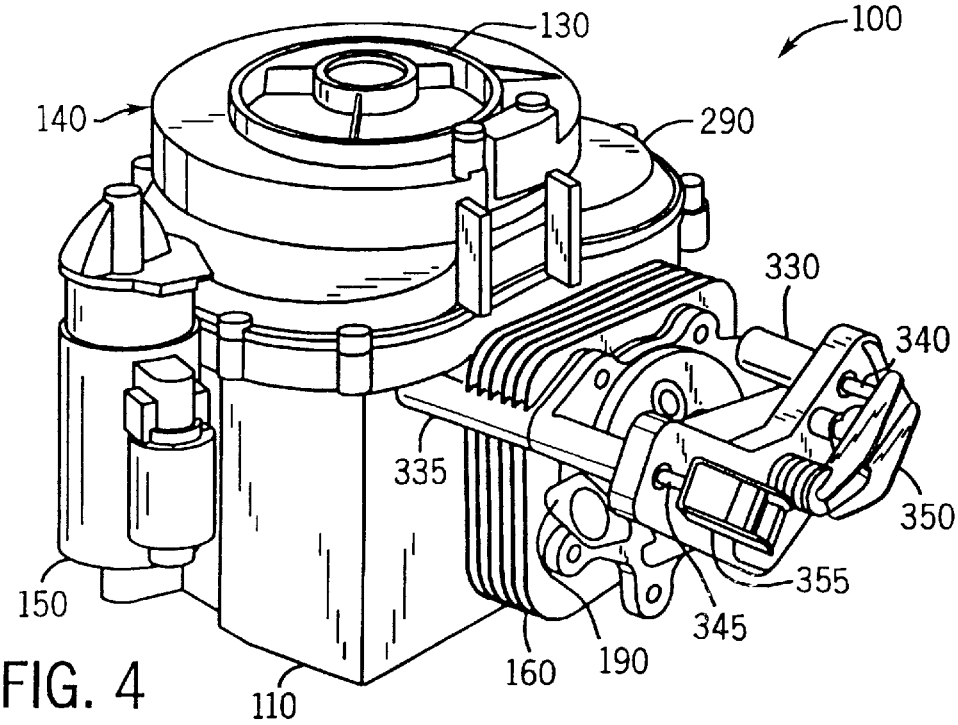
FIG. 4 is a fourth perspective view of the single cylinder engine of FIG. 1, in which certain parts of the engine have been removed to reveal additional internal parts of the engine.

Referring to FIGS. 3 and 4, the engine 100 is shown with the blower housing 120 removed to expose a top 290 of the crankcase 110. With respect to FIG. 3, in which both the fan 130 and the flywheel 140 are also removed, a coil 300 is shown that generates an electric current based upon rotation of the fan 130 and/or the flywheel 140, which together operate as a magneto. Additionally, the top 290 of the crankcase 110 is shown to have a pair of lobes 310 that cover a pair of spur-toothed gears 320, 325 (see FIGS. 5 and 7–8). With respect to FIG. 4, the fan 130 and the flywheel 140 are shown above the top 290 of the crankcase 110. Additionally, FIG. 4 shows the engine 100 without the rocker arm cover 180, to more clearly reveal a pair of tubes 330, 335 through which extend a pair of respective push rods 340, 345. The push rods 340, 345 extend between a pair of respective rocker arms 350, 355 and a pair of cams 360, 365 (see FIG. 8) within the crankcase 110, as discussed further below.

Figure 5:
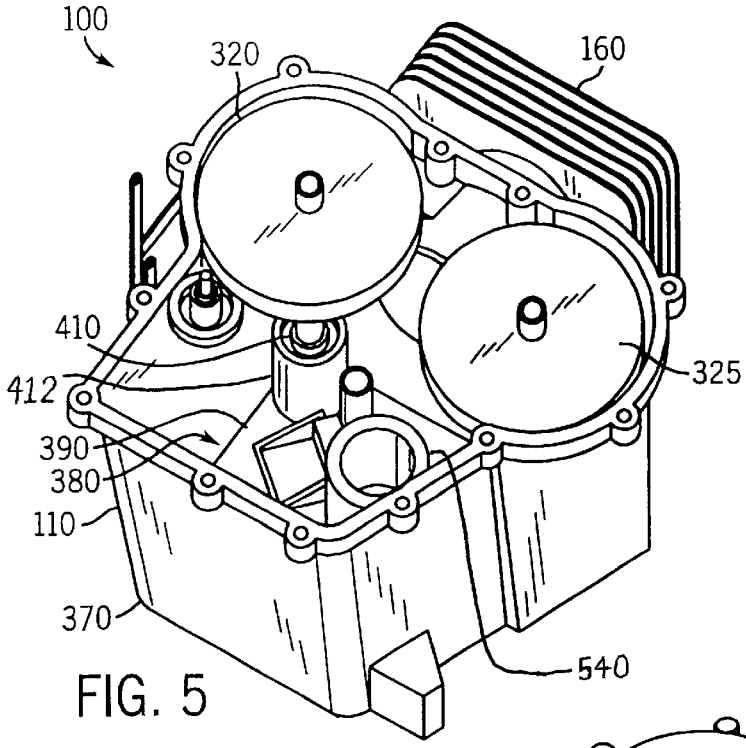
FIG. 5 is a fifth perspective view of the single cylinder engine of FIG. 1, in which a top of the crankcase has been removed to reveal an interior of the crankcase.
Figure 6:
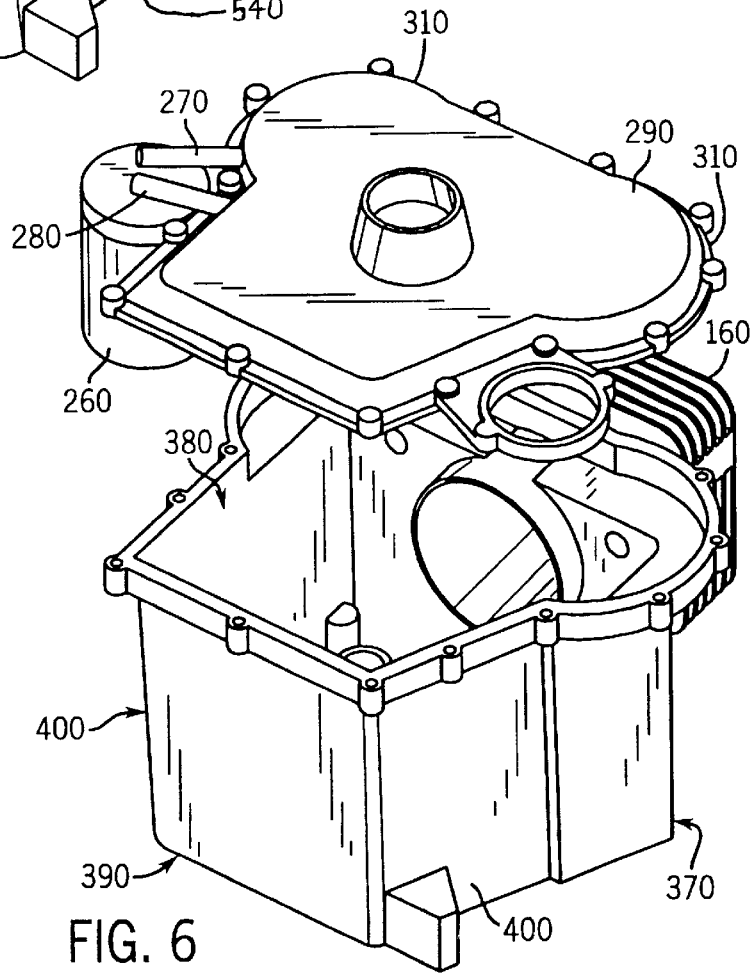
FIG. 6 is a sixth perspective view of the single cylinder engine of FIG. 1, in which the top of the crankcase is shown exploded from the bottom of the crankcase.

Turning to FIGS. 5 and 6, the engine 100 is shown with the top 290 of the crankcase 110 removed from a bottom 370 of the crankcase 110 to reveal an interior 380 of the crankcase. Additionally in FIGS. 5 and 6, the engine 100 is shown in cut-away to exclude portions of the engine that extend beyond the cylinder 160 such as the cylinder head 170. With respect to FIG. 6, the top 290 of the crankcase 110 is shown above the bottom 370 of the crankcase in an exploded view. In this embodiment, the bottom 370 includes not only a floor 390 of the crankcase, but also all four side walls 400 of the crankcase, while the top 290 only acts as the roof of the crankcase. The top 290 and bottom 370 are manufactured as two separate pieces such that, in order to open the crankcase 110, one physically removes the top from the bottom. Also, as shown in FIG. 5, the pair of gears 320, 325 within the crankcase 110 form part of respective camshafts 410, 415 (see also FIG. 8) which in turn are supported by the bottom 370 of the crankcase 110. As discussed further with respect to FIGS. 9–12, the camshaft 410 in particular is supported by a pump 412, which in turn is supported by the bottom 370 of the crankcase 110. Because of its location along the bottom 370 of the crankcase 110, which acts as an oil reservoir, the pump 412 receives oil collected within the bottom 370 of the crankcase 110. The pump 412 further is actuated due to the rotation of the camshaft 410. A lower crankshaft bearing 540 for supporting the crankshaft 220 is additionally shown in FIG. 5 along the floor 390.

Figure 7:
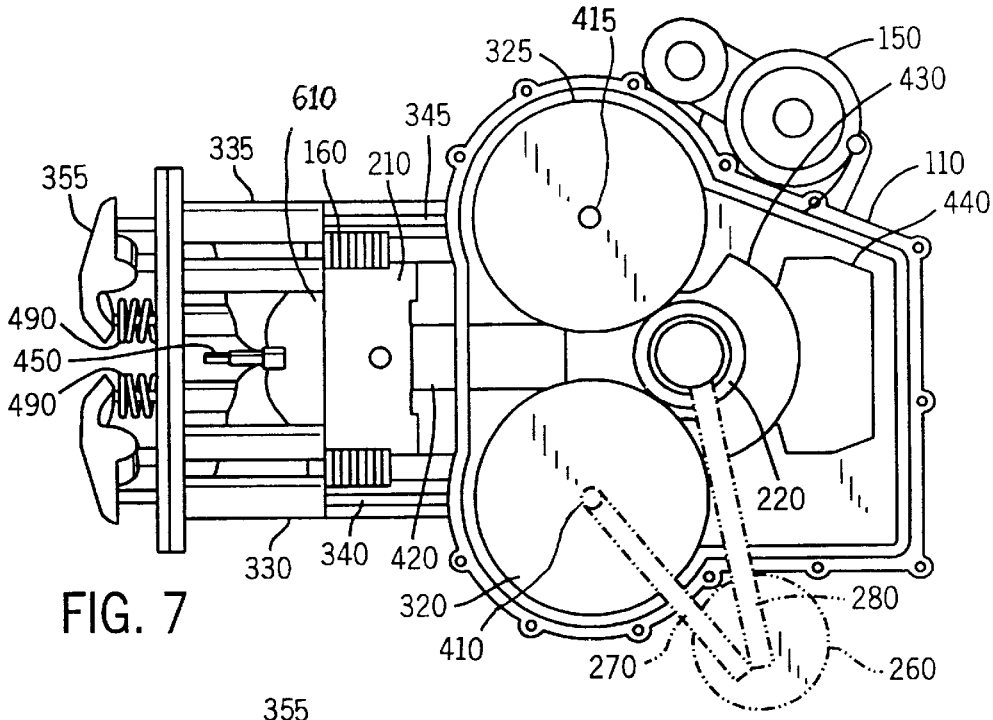
FIG. 7 is a top view of the single cylinder engine of FIG. 1, showing internal components of the engine.

Referring to FIG. 7, a top view of the engine 100 is provided in which additional internal components of the engine are shown. In particular, FIG. 7 shows the piston 210 within the cylinder 160 to be coupled to the crankshaft 220 by a connecting rod 420. The crankshaft 220 is in turn coupled to a rotating counterweight 430 and weights 440, which balance the forces exerted upon the crankshaft 220 by the piston 210. A gear on the crankshaft 220 further is in contact with each of the gears 320, 325, and thus the crankshaft communicates rotational motion to the camshafts 410, 415. FIG. 7 further shows a spark plug 450 located on the cylinder head 170, which provides sparks during power strokes of the engine to cause combustion to occur within the cylinder 160. The electrical energy for the spark plug 450 is provided by the coil 300 (see FIG. 3).

Figure 8:
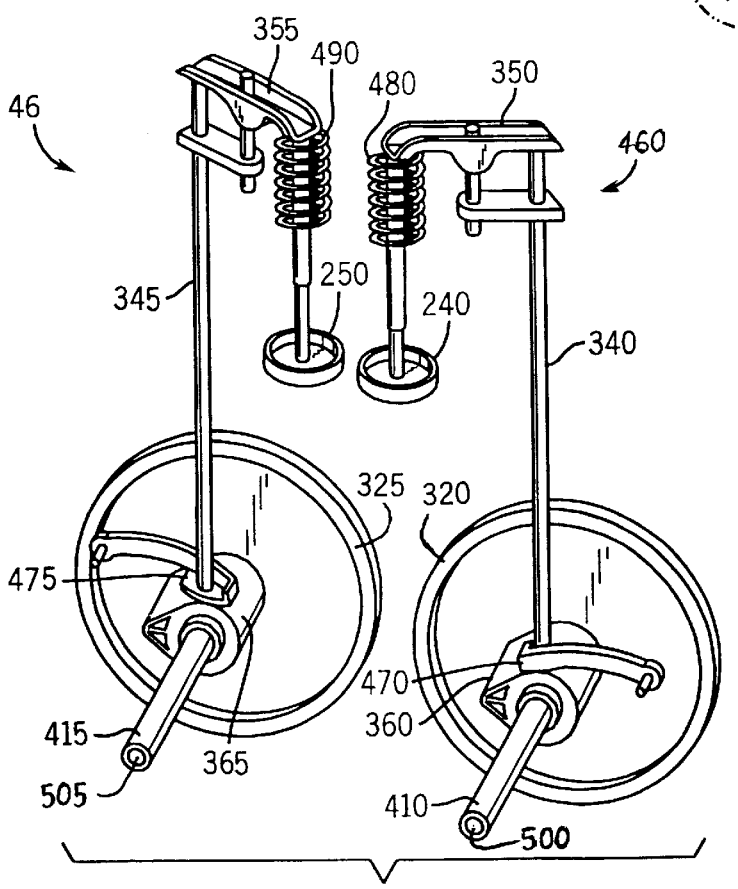
FIG. 8 is a perspective view of components of a valve train of the single cylinder engine of FIG. 1.

Further referring to FIG. 7, and additionally to FIG. 8, elements of two valve trains 460, 461 of the engine 100 are shown. The valve trains 460, 461 respectively include the respective camshafts 410, 415 which include the respective gears 320, 325 and also include respective single-lobe cams 360, 365 underneath the gears, respectively. Because each of the camshafts 410, 415 includes only a single cam with a single lobe, the camshafts (in contrast to camshafts having multiple cams) can be easily molded or otherwise machined from single pieces of robust plastics or other materials. The use of such robust materials allows for quieter interaction of the cams 360, 365 with respect to the respective push rods 340, 345, and thus quieter operation of the engine 100 overall. In one embodiment, the cams 360, 365 are integrally molded onto the respective backsides of the respective gears 320, 325, and the camshafts 410, 415 are identical to allow for even easier mass-production of the camshafts.

Additionally, respective cam follower arms 470, 475 that are rotatably mounted to the crankcase 110 extend to rest upon the respective cams 360, 365. The respective push rods 340, 345 in turn rest upon the respective cam follower arms 470, 475. As the cams 360, 365 rotate, the push rods 340, 345 are temporarily forced outward away from the crankcase 110 by the cam follower arms 470, 475, which slidingly interface the rotating cams. This causes the rocker arms 350, 355 to rock or rotate, and consequently causes the respective valves 240 and 250 to open toward the crankcase 110. As the cams 360, 365 continue to rotate, however, the push rods 340, 345 are allowed by the cam follower arms 470, 475 to return inward to their original positions.

A pair of springs 480, 490 positioned between the cylinder head 170 and the rocker arms 350, 355 provide force tending to rock the rocker arms in directions tending to close the valves 240, 250, respectively. Further as a result of this forcing action of the springs 480, 490 upon the rocker arms 350, 355, the push rods 340, 345 are forced back to their original positions. The valve trains 460, 461 are designed to have appropriate rocker ratios and masses to control contact stress levels with respect to the cams 360, 365. FIG. 7 additionally shows that the components of the respective valve trains 460, 461 are positioned on opposite sides of the cylinder 160 and cylinder head 170, thus exposing a valve bridge area 610.

In the present embodiment, the engine 100 is a vertical shaft engine capable of outputting 15–20 horsepower for implementation in a variety of consumer lawn and garden machinery such as lawn mowers. In alternate embodiments, the engine 100 can also be implemented as a horizontal shaft engine, be designed to output greater or lesser amounts of power, and/or be implemented in a variety of other types of machines, e.g., snow-blowers. Further, in alternate embodiments, the particular arrangement of parts within the engine 100 can vary from those shown and discussed above. For example, in one alternate embodiment, the cams 360, 365 could be located above the gears 320, 325 rather than underneath the gears.

Referring still to FIG. 8, the camshafts 410, 415 have respective internal channels 500, 505, through which oil or other lubricant can be communicated. The internal channel 500 in particular communicates oil upward from the pump 412 to the gear 320, while the internal channel 505 communicates oil downward from the gear 325 to the base of the camshaft 415, where that camshaft rests upon the floor 390 of the crankcase 110. As discussed more fully with reference to FIG. 16, the internal channels 500, 505 form a portion of an overall oil circuit of the engine 100.

Figure 9:
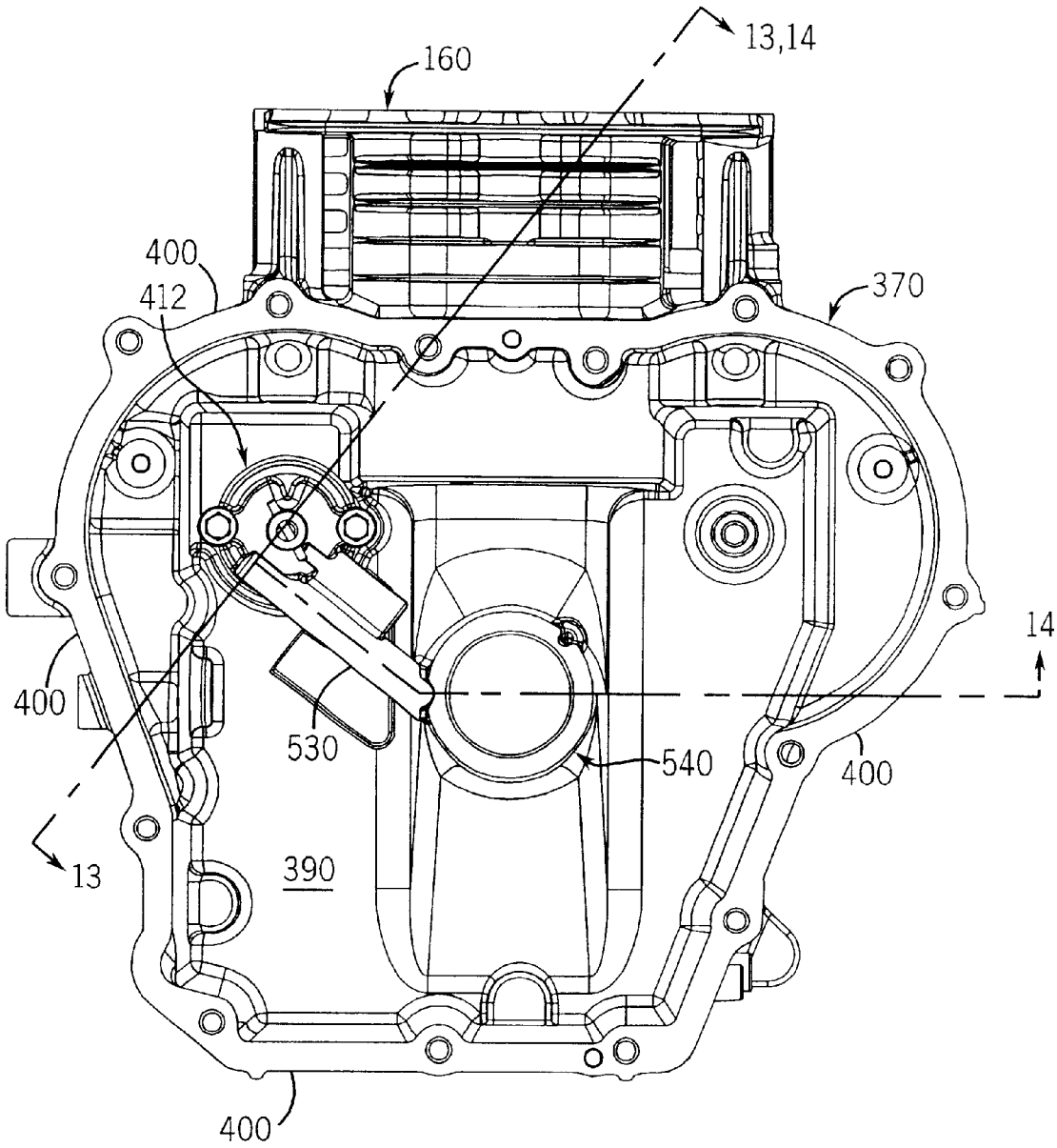
FIG. 9 is a top view of the bottom of the crankcase and the cylinder of the single cylinder engine of FIG. 1, which in particular shows a pump.
Figure 10:
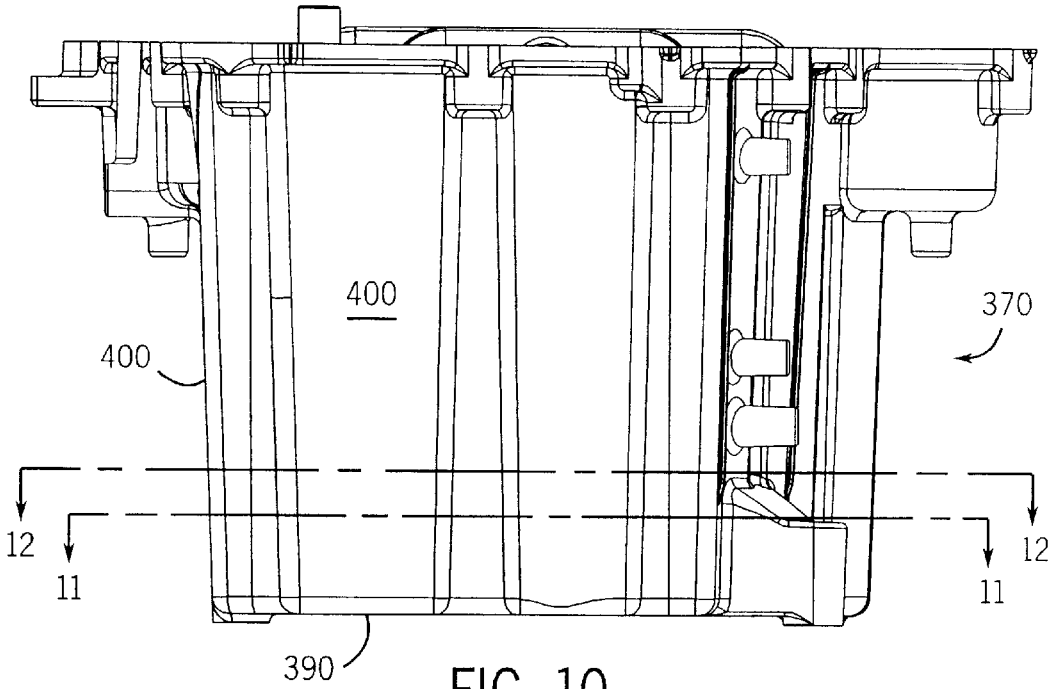
FIG. 10 is an elevation view of the bottom of the crankcase of the single cylinder engine of FIG. 1, as viewed from the side of the crankcase opposite the cylinder.

Turning to FIGS. 9 and 10, a top view and an elevation view (as viewed from the side wall 400 opposite the cylinder 160) of the bottom 370 of the crankcase 110 are provided. FIG. 9 in particular shows the pump 412 supported by the floor 390 of the crankcase. Further referring to FIGS. 11–14, the pump 412 is shown in greater detail. As shown particularly with respect to FIGS. 11–12, which are sectional views of the pump 412 taken along lines 11—11 and 12—12 of FIG. 10, respectively, the pump in a preferred embodiment is a gerotor pump (or, alternatively, a crescent pump) of conventional design having an inner gear 510 positioned within an outer ring gear 515 having gear teeth along its inner circumference.

Figure 13:
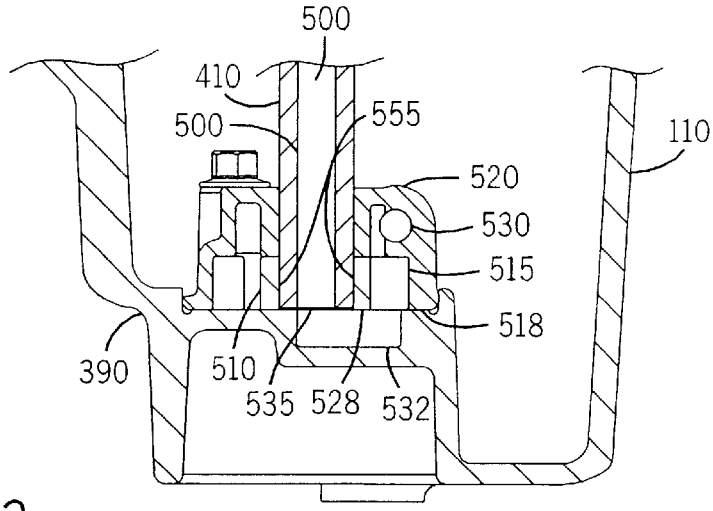
FIG. 13 is a cross-sectional side view of the bottom of the crankcase of FIGS. 9–10 and the pump of FIGS. 11–12, taken along line 13—13 of FIG. 9.
Figure 14:
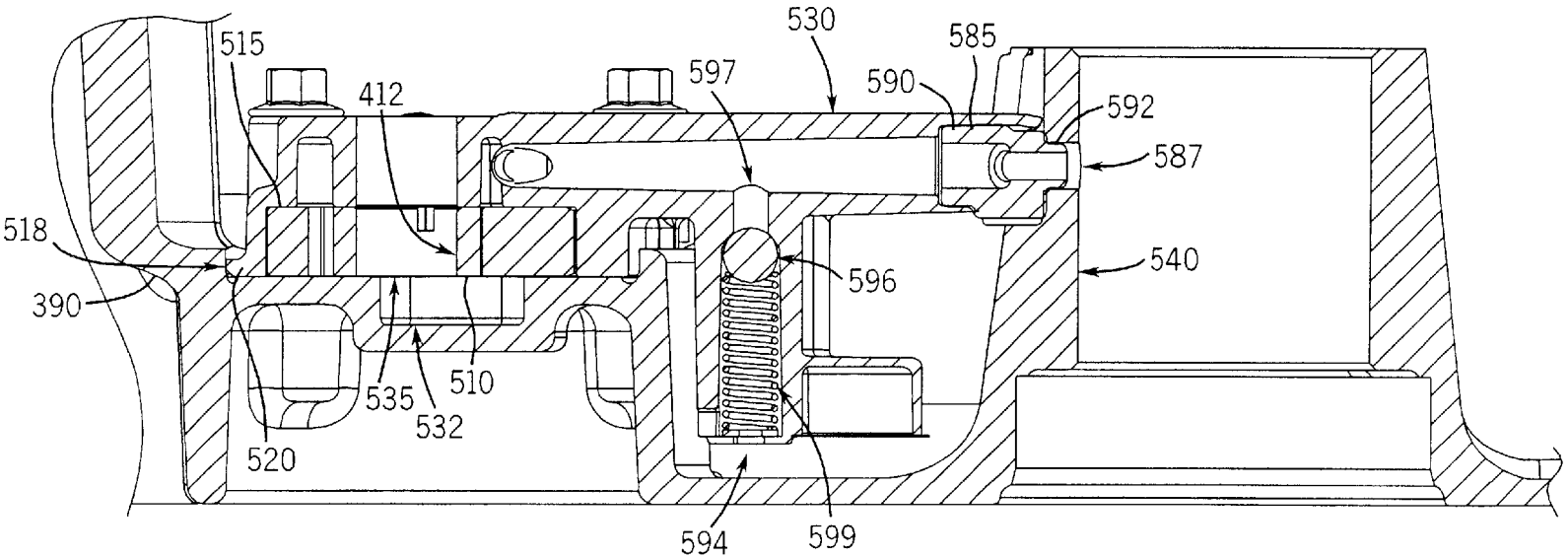
FIG. 14 is a cross-sectional side view of the bottom of the crankcase of FIGS. 9–10 and the pump of FIGS. 11–12, taken along line 14—14 of FIG. 9, which in particular shows an oil passage connecting the pump with a crankshaft bearing.

As shown in FIGS. 13–14, which are cross-sectional views taken along lines 13—13 and 14—14 of FIG. 9, respectively, the inner gear 510 and the outer ring gear 515 are contained within a housing 520 that rests within a cavity 518 in the floor 390 of the crankcase 110. In the embodiment shown, the gears 510, 515 specifically rest upon the floor 390, and the housing 520 extends upward from the floor 390 around the gears. However, in alternate embodiments, the gears 510, 515 are fully contained within the housing, which in turn rests upon the floor 390. The housing is made from a rigid material so that the dimensional envelope around the gears 510, 515 is more accurate to provide improved performance of the pump 412.

Figure 11:
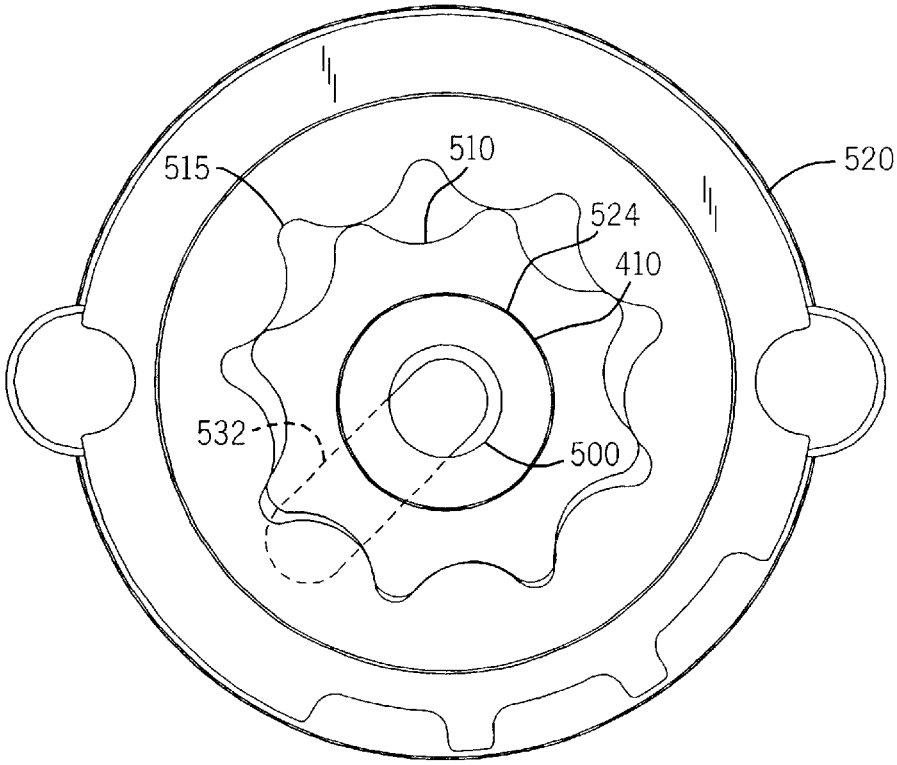
FIGS. 11 and 12 are cross-sectional views of one embodiment of the pump shown in FIG. 9, taken along lines 11—11 and 12—12 of FIG. 10.

Particularly as shown in FIGS. 11 and 13, the inner gear 510 has an interior hole 524 through which is positioned the camshaft 410. Thus, the internal channel 500 of the camshaft 410 extends all of the way to a bottom side 528 of the inner gear 510. The inner gear 510 is press fit onto, or otherwise coupled to, the camshaft 410. Consequently, when the camshaft 410 is driven to rotate, this causes the inner gear 510 and thus the outer ring gear 515 to rotate within the housing 520. The floor 390 of the crankcase 110 or, in alternate embodiments, a portion of the housing 520, supports the inner gear 510 and the camshaft 410 and consequently forms a lower camshaft bearing 555 for that camshaft.

Figure 12:
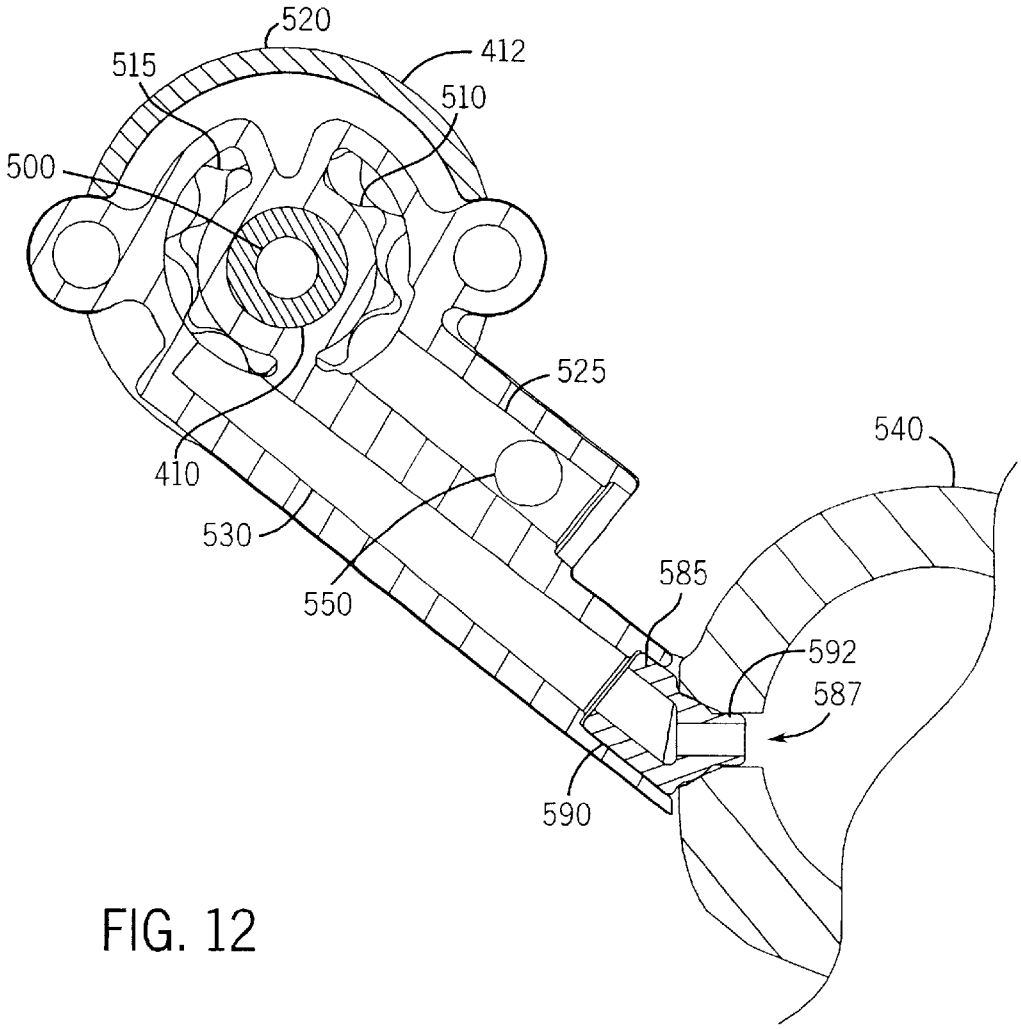

Referring to FIG. 12, as with other gerotor (or crescent) pumps, the inner gear 510 of the pump 412 has a fewer number of gear teeth than the outer ring gear 515 and the two gears have center axes that are somewhat offset from one another. Consequently, when the gears 510 and 515 rotate, a partial vacuum is created within an inlet tube 525 of the pump 412 so that oil is drawn into the pump 412 from along the floor 390 of the crankcase outside the housing 520 at an inlet orifice 550. Further, referring also to FIG. 13, the oil that is drawn into the pump 412 due to operation of the pump in turn is pumped out of the pump at both a bleed outlet 535 and a crankshaft bearing outlet 530.

As shown in FIGS. 11, 13 and 14, the bleed outlet 535 is formed by a slot 532 within the floor 390 of the crankcase 110 (or otherwise within the housing 520) that extends radially from between the inner and outer ring gears 510, 515 under the inner gear to the interior hole 524. Due to the positioning of the bleed outlet 535, the inner gear 510, the camshaft 410 and the internal channel 500, some of the oil that is pumped out of the bleed outlet lubricates the lower bearing 555 of the shaft/inner gear. Other oil that is pumped out of the bleed outlet 535 is pumped up through the internal channel 500 of the camshaft 410. This oil provides lubrication for a number of other components of the engine 100, as discussed further with respect to FIGS. 16–17.

As shown in both FIGS. 12 and 14, the crankshaft bearing outlet 530 is a tube that extends from the pump 412 along the top of the pump almost to the lower crankshaft bearing 540 for supporting the crankshaft 220. An additional connecting device 585 is employed to connect the crankshaft bearing outlet 530 to the lower crankshaft bearing 540 and further through an orifice 587 in the bearing to the interior of the bearing, thus completing an oil passage from the pump 412 to the bearing 540. The connecting device 585 in one embodiment is a rubberized tube having a first end 590 designed to extend into the crankshaft bearing outlet 530, and a second end 592 designed to fit into the orifice 587. Oil flows through the connecting device 585 from the crankshaft bearing outlet 530 into the lower crankshaft bearing 540. In the embodiment shown in FIG. 14, the crankshaft bearing outlet 530 also includes a pressure relief valve 594 that allows oil to exit out of the crankshaft bearing outlet 530 by way of a hole 597 in that outlet, so that oil can exit the system if oil pressure becomes excessive. In the embodiment shown, the valve 594 includes a ball 596 and spring 599, although other types of valves can also be employed.

Figure 15:
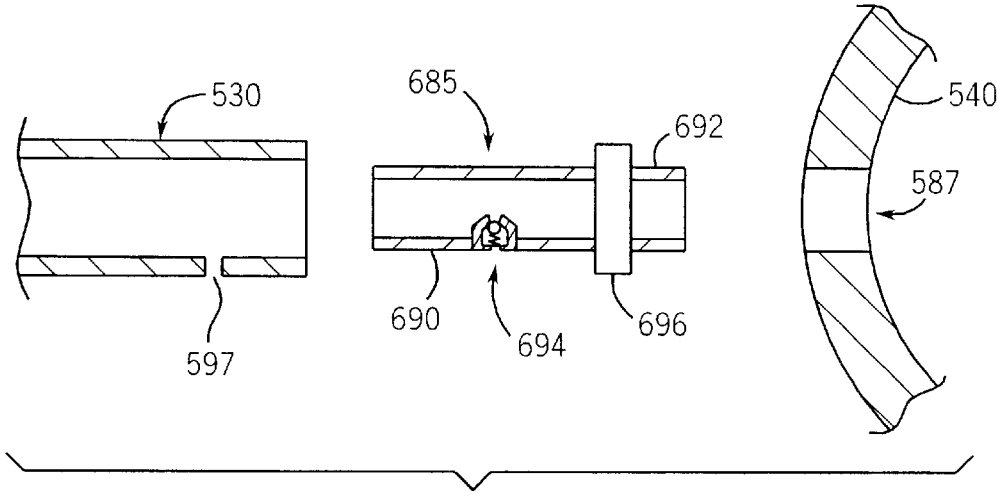
FIG. 15 is an exploded view of an alternate embodiment of an oil passage connecting a pump with a main crankshaft bearing (in contrast to that of FIG. 14)

Referring to FIG. 15, an exploded view of an alternate embodiment of oil passage to that of FIGS. 12 and 14 is shown. Specifically, FIG. 15 shows an alternate connecting device 685 that connects the crankshaft bearing outlet 530 and the bearing 540. Specifically, the connecting device 685 has a first end 690 that is separated from a second end 692 by a rim 696 extending out from the connecting device in between the first and second ends. The rim 696 keeps the connecting device 685 in position relative to the crankshaft bearing outlet 530 and the lower crankshaft bearing 540. The first end 690 is sufficiently long that it extends past the hole 597, and a ball-and-spring valve 694 (or another type of valve) is supported by the first end 690 at a location that is aligned with the hole 597 when the connecting device 685 is inserted into the outlet 530.

Figure 16:
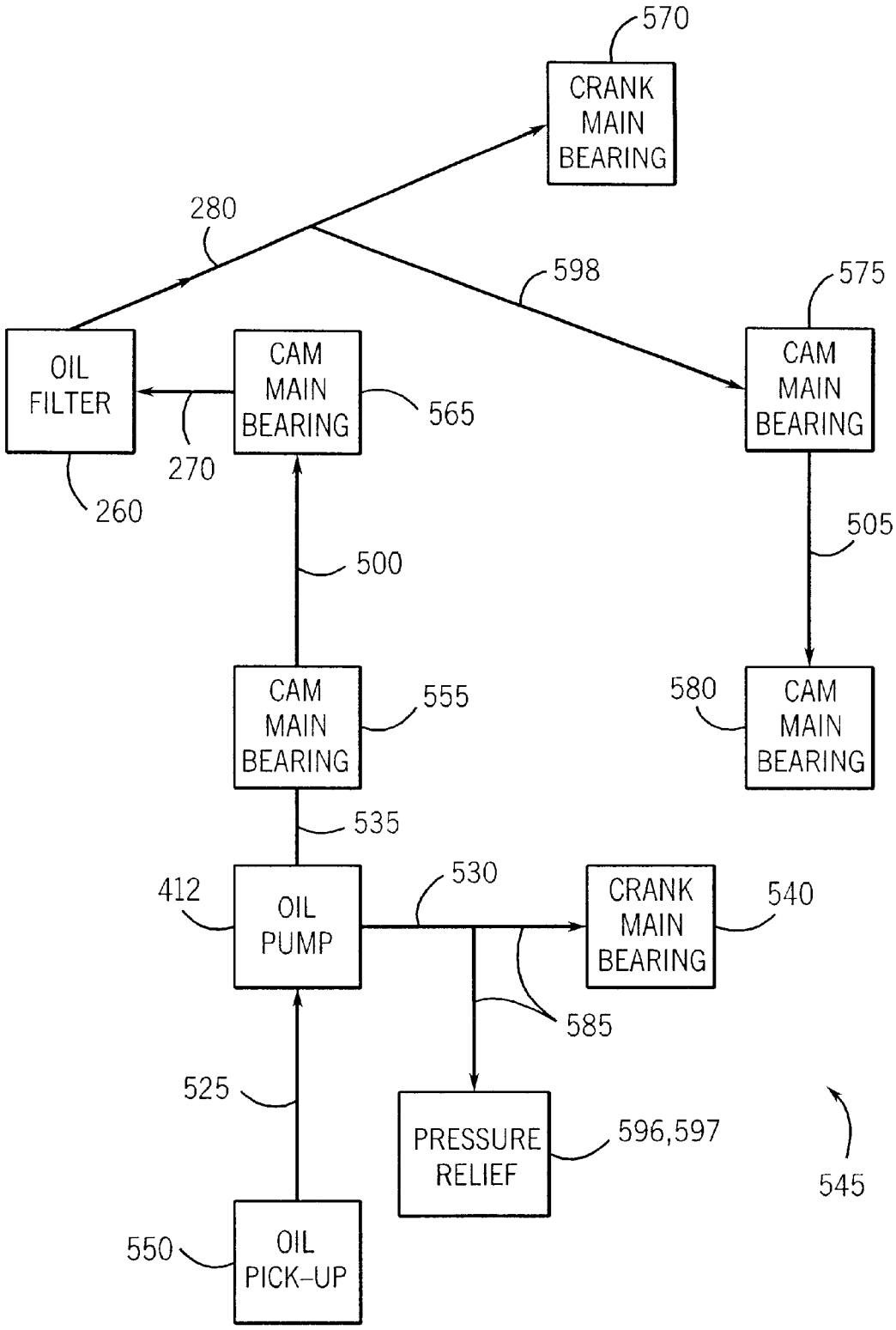
FIG. 16 is a block diagram showing an oil circuit within the single cylinder engine of FIG. 1.

Referring to FIG. 16, a block diagram shows schematically an overall oil circuit 545 of the engine 100 by which oil is pumped from the floor 390 of the crankcase 110 to various components within the engine. As shown, oil is drawn into the inlet tube 525 at the inlet orifice 550, which forms an oil pick-up along the floor 390 of the crankcase 110. The oil is then provided to the oil pump 412, which pumps some of the oil out at the bleed outlet 535 at the lower camshaft bearing 555 for the camshaft 410. The remainder of the oil is pumped through the crankshaft bearing outlet 530. That oil is provided, by way of the connecting device 585 (or the connecting device 685), to the lower crankshaft bearing 540 and/or back to the floor 390 of the crankcase 110 (outside of the pump 412) by way of the pressure relief valve 594 (or valve 694) and hole 597.

Most of the oil pumped out at the bleed outlet 535 does not remain at the lower camshaft bearing 555 but rather proceeds up through the internal channel 500 of the camshaft 410 and out along an upper camshaft bearing 565 of that camshaft. Most of the oil then proceeds through the incoming line 270 to the oil filter 260, at which the oil is filtered. Once filtered, the oil proceeds through the outgoing line 280. Some of the oil is deposited at an upper crankshaft bearing 570, while some of the oil further proceeds along an additional line 598 to an upper camshaft bearing 575 of the shaft 415. A portion of that oil further then proceeds down the internal channel 505 of the shaft 415 to the remaining, lower camshaft bearing 580 of that shaft along the bottom 370 of the crankcase 110.

Figure 17:
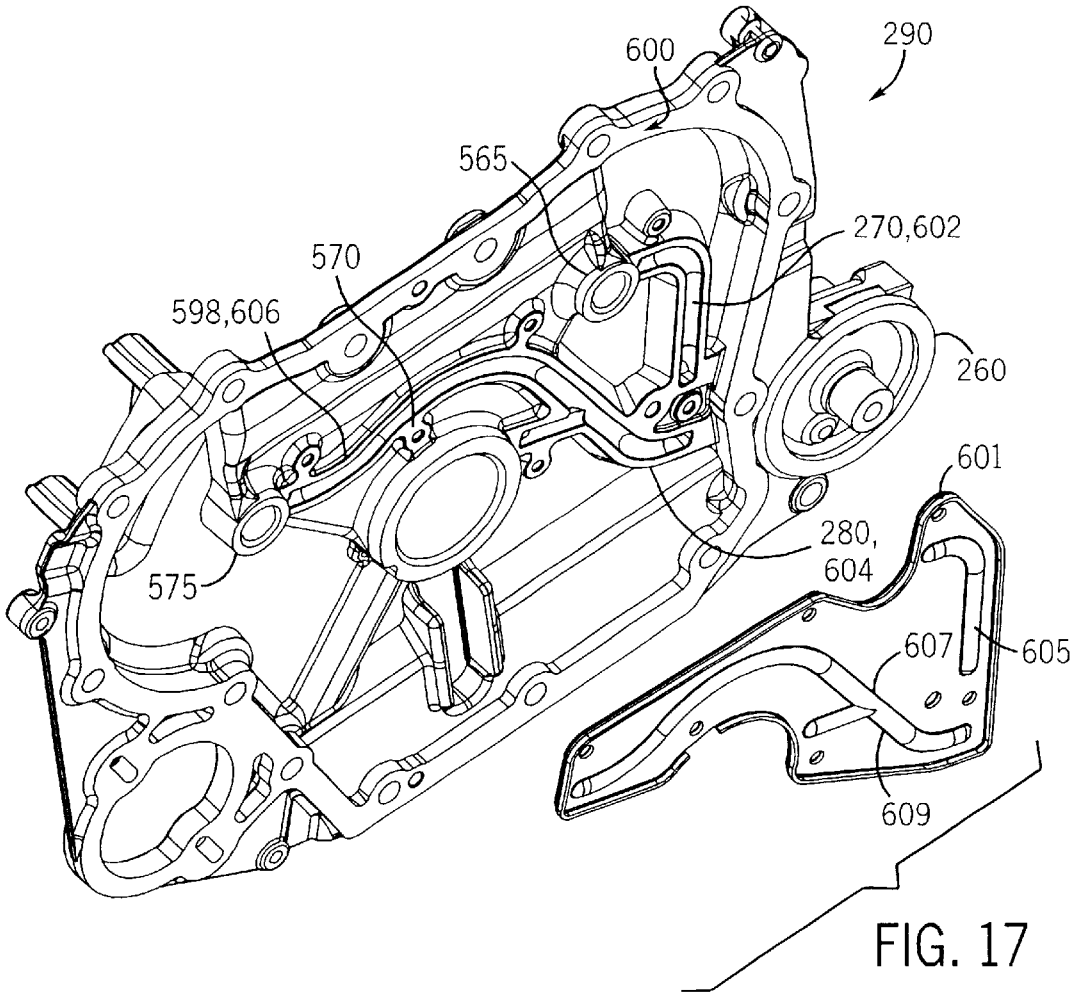
FIG. 17 is a view of a lower side of the top of the crankcase of the single cylinder engine shown in FIG. 6, with a plate used to cover molded passages within the top shown exploded from the remainder of the top.

FIG. 17 shows an interior side 600 of the top 290 of the crankcase 110 to further clarify the design of the oil circuit 545. In particular, the upper camshaft bearings 565, 575 for supporting the respective camshafts 410, 415 and the upper crankshaft bearing 570 for supporting the crankshaft 220 are shown. Also shown are indentations 602, 604 and 606 molded in the top 290 to form the incoming, outgoing and additional lines 270, 280 and 598 that respectively couple the upper camshaft bearing 565 with the oil filter 260, and couple the oil filter with the upper crankshaft bearing 570 and with the upper camshaft bearing 575. The indentations 602, 604 and 606 are semicircular in cross section, and the lines 270, 280 and 598 are formed by covering the indentations with a panel 601.

Although the panel 601 can be flat, in the embodiment shown the panel has grooves 605, 607 and 609 that complement the indentations 602, 604 and 606 to form the lines 270, 280 and 598, respectively. The panel 601 can be attached to the top 290 by way of screws or other fastening components or methods. The exact paths of the incoming and outgoing lines 270, 280 shown in FIG. 8 are somewhat different than those shown in FIG. 7, insofar as the paths shown in FIG. 7 are straight while those of FIG. 8 are more curved. Thus, depending upon the embodiment, the incoming, outgoing, and additional lines 270, 280 and 598 can follow a variety of different paths. This manner of creating the lines 270, 280 and 598 by way of molded indentations and the panel 601 is simpler and more cost-effective than alternative methods in which enclosed channels are fully cast into the top 290 through the use of cores, etc., although the lines could be created using such other methods in alternate embodiments.

The embodiments discussed above have various advantages in comparison with conventional systems. In particular, because oil is conducted through the camshafts 410 and 415, oil passages do not need to be cast or otherwise created in the sides of the walls of the crankcase in order to provide oil from the floor of the crankcase to the bearings along the top of the crankcase. Further, because the top 290 is removable and can be simply manufactured to include the incoming, outgoing and additional lines, the costs associated with manufacturing the oil circuit providing oil to the oil filter and to the various bearings along the top of the crankcase are further reduced in comparison with conventional designs.

Also, since the first and second camshafts 410, 415 including the gears 320, 325 and the cams 360, 365 are respectively identical, and each camshaft includes only a single cam, these parts can be inexpensively manufactured by way of injection molding, from materials such as robust plastics that produce relatively little noise during operation of the engine as the cams interface the push rods of the engine. Additionally, the twin-cam design has the added benefit that the push rods, rocker arms and valves corresponding to the intake and exhaust valves are positioned on opposite sides of the cylinder and cylinder head, such that the valve bridge area 610 is more exposed to air being blown by the fan and therefore is more effectively cooled.

While the foregoing specification illustrates and describes the preferred embodiments of this invention, it is to be understood that the invention is not limited to the precise construction herein disclosed. The invention can be embodied in other specific forms without departing from the spirit or essential attributes of the invention. For example, other types of pumps can be employed in place of the gerotor/crescent pumps shown. Accordingly, reference should be made to the following claims, rather than to the foregoing specification, as indicating the scope of the invention.

What is claimed is:

1. An internal combustion engine comprising:

a crankcase having a floor;

a pump supported by the floor of the crankcase, the pump including an inlet and a first outlet;

a first camshaft having a first cam, first and second camshaft ends, and a first internal channel extending within the first camshaft between the first and second camshaft ends;

wherein the first camshaft end is supported by one of the pump and the floor;

wherein rotation of the first camshaft causes the pump to draw in lubricant via the inlet and to pump out at least a first portion of the lubricant via the first outlet;

wherein the first outlet is positioned in proximity to the first internal channel at the first camshaft end, so that at least some of the first portion of the lubricant pumped out via the first outlet is pumped into the first internal channel; and wherein the pump further includes a second outlet.

2. The internal combustion engine of claim 1, wherein one of the pump and the floor forms a first camshaft bearing for supporting the first camshaft end, wherein the first camshaft bearing is lubricated by at least some of the first portion of the lubricant pumped out via the first outlet.

3. The internal combustion engine of claim 1, further comprising:

a crankshaft having first and second crankshaft ends, wherein the first crankshaft end is supported by a first crankshaft bearing on the crankcase;

wherein the first camshaft includes a first camshaft gear that interfaces a crankshaft gear on the crankshaft, so that when the crankshaft rotates, the first camshaft rotates in response.

4. The internal combustion engine of claim 3, further comprising a connection tube, wherein the first crankshaft bearing includes a first orifice;

wherein a first end portion of the connection tube is supported within the second outlet and a second end portion of the connection tube is supported within the first orifice.

5. The internal combustion engine of claim 3, further comprising:

an oil filter;

a second crankshaft bearing on the crankcase that supports a second crankshaft end;

a second camshaft bearing on the crankcase that supports the second camshaft end;

a first crankcase channel coupling the second camshaft bearing to the oil filter; and a second crankcase channel coupling the oil filter to a second crankshaft bearing supporting the second crankshaft end;

wherein the second camshaft bearing is lubricated by at least some of the first portion of the lubricant;

wherein at least some of the first portion of the lubricant is communicated to the oil filter for filtering; and wherein the second crankshaft bearing is lubricated by at least some of the lubricant that is filtered.

6. The internal combustion engine of claim 1, further comprising:

a second camshaft having a second cam, third and fourth camshaft ends, and a second internal channel extending within the second camshaft between the third and fourth camshaft ends;

wherein the third and fourth camshaft ends are supported by third and fourth camshaft bearings on the crankcase.

7. The internal combustion engine of claim 6, further comprising:

first and second push rods respectively coupled to first and second rocker arms, which are respectively coupled to an intake valve and an exhaust valve of a cylinder of the engine;

wherein the first push rod is in contact with the first cam so that rotation of the first camshaft causes linear motion of the first push rod, and wherein the second push rod is in contact with the second cam so that additional rotation of the second camshaft causes additional linear motion of the second push rod.

8. The internal combustion engine of claim 7, wherein the first and second camshafts have first and second gears; and wherein the first and second camshafts with the first and second gears, the first and second push rods, the first and second rocker arms, and intake and exhaust valves are, respectively, positioned on opposite sides of the cylinder so a valve bridge area of the cylinder is exposed to receive air blown across the cylinder by way of a fan coupled to the engine.

9. The internal combustion engine of claim 6, further comprising:

a first crankcase channel connected to the third camshaft bearing by which at least some of the first portion of the lubricant is provided to the third camshaft bearing and additionally at least some of the first portion of the lubricant is provided into the second internal channel and communicated to the fourth camshaft bearing.

10. The internal combustion engine of claim 9, further comprising:

a crankshaft having first and second crankshaft ends that are respectively supported by first and second crankshaft bearings on the crankcase.

11. The internal combustion engine of claim 10, further comprising:

a second crankcase channel coupled to the first crankcase channel, the second crankcase channel communicating at least some of the first portion of the lubricant to the second crankshaft bearing and at least some of the first portion of the lubricant to the first crankcase channel.

12. The internal combustion engine of claim 11, further comprising:

a third crankcase channel coupled between the second camshaft bearing and the oil filter, wherein the third crankcase channel communicates at least some of the first portion of the lubricant to the oil filter, and wherein the filtered lubricant is in turn provided to the second crankcase channel; and wherein at least some of the first portion of the lubricant is provided to the second camshaft bearing.

13. The internal combustion engine of claim 6, wherein the first camshaft includes a first gear and the second camshaft includes a second gear, wherein the first cam is integrally molded onto the first gear and the second cam is integrally molded onto the second gear.

14. The internal combustion engine of claim 13, wherein the first and second camshafts are identical, and wherein the first and second camshafts are manufactured from a robust plastic so that contact between the first and second cams and respective first and second push rods produces reduced noise.

15. The internal combustion engine of claim 1, wherein the pump includes an inner gear, an outer ring gear and a housing, wherein the inner gear has teeth that engage complementary teeth along an inner circumference of the outer ring gear, and wherein the first camshaft end is coupled to the inner gear so that rotation of the first camshaft produces rotation of the inner gear, which in turn causes rotation of the outer gear.

16. The internal combustion engine of claim 15, wherein the floor of the crankcase includes a cavity in which is situated the pump, and further includes a radial slot extending under the inner gear from a first position in between the inner gear and the outer ring gear to a second position proximate a middle of the inner gear, and wherein the radial slot at the second position forms the first outlet that is proximate the first inner channel.

17. The internal combustion engine of claim 1, wherein the second outlet has a primary orifice and a pressure relief orifice; and wherein rotation of the first camshaft causes the pump to pump out a second portion of the lubricant via the second outlet, at least some of which is directed toward the first crankshaft bearing.

18. An internal combustion engine comprising:

a crankcase having a floor;

a pump supported by the floor of the crankcase, the pump including an inlet and a first a first camshaft having a first cam, first and second camshaft ends, and a first internal channel extending within the first camshaft between the first and second camshaft ends;

wherein the first camshaft end is supported by one of the pump and the floor;

wherein rotation of the first camshaft causes the pump to draw in lubricant via the inlet and to pump out at least a first portion of the lubricant via the first outlet;

wherein the first outlet is positioned in proximity to the first internal channel at the first camshaft end, so that at least some of the first portion of the lubricant pumped out via the first outlet is pumped into the first internal channel; and wherein the crankcase includes a main portion including the floor and a plurality of sides, and further includes a top portion that is detachable from the main portion, wherein the top is molded so that an inner surface of the top includes a plurality of indentations that, when covered with a panel, form channels.

19. An internal combustion engine comprising:

means for converting rotational motion imparted by a crankshaft into linear motion used to actuate a valve;

means for pumping lubricant;

means for communicating a first portion of the lubricant through at least a portion of the means for converting; and additional means for communicating a second portion of the lubricant away from the means for pumping;

wherein the means for pumping is actuated by the means for converting; and wherein the means for pumping pumps the first portion of the lubricant into the means for communicating and into the additional means for communicating.

20. A method of distributing lubricant within an internal combustion engine, the method comprising:

providing a crankshaft, a first camshaft having an internal channel extending between first and second ends of the first camshaft, a pump having an inlet and a first outlet and a second outlet, and a first bearing for the first end of the first camshaft, wherein the first outlet is proximate the internal channel at the first end of the first camshaft;

rotating the crankshaft;

imparting rotational motion from the crankshaft to the first camshaft;

imparting additional rotational motion from the first camshaft to at least a portion of the pump;

pumping the lubricant from the inlet of the pump to the first outlet and the second outlet of the pump as a result of the additional rotational motion, so that a first portion of the lubricant is pumped into the internal channel at the first end of the first camshaft so that the lubricant is communicated through the internal channel to the second end of the first camshaft, and a second portion of the lubricant is pumped to an additional destination.

21. The method of claim 20, further comprising:

providing a second camshaft having a second internal channel between third and fourth ends of the second camshaft;

imparting further rotational motion from the crankshaft to the second camshaft;

converting the rotational motion of the first camshaft and the further rotational motion of the second camshaft into linear motion of first and second push rods, respectively, which in turn causes opening and closing of intake and exhaust valves, respectively.

22. The method of claim 21, further comprising:

providing at least one channel along a surface of the crankcase linking a second bearing for supporting the second end of the first camshaft to a crankshaft bearing and to a third bearing for supporting the third end of the second camshaft;

providing a third portion of the lubricant to the second bearing supporting the second end of the first camshaft;

providing a fourth portion of the lubricant to the crankshaft bearing and to the third bearing by way of the at least one channel.

23. An internal combustion engine comprising:

a bottom crankcase section;

a top crankcase section that is removably coupled to the bottom crankcase section, wherein the top crankcase section includes a channel;

a camshaft supported at bottom and top bearings proximate the bottom and top crankcase sections, respectively, wherein the camshaft includes an internal passage extending between first and second ends of the camshaft; and a pump proximate a floor of the bottom crankcase section that is actuated by the camshaft;

wherein actuation of the pump causes lubricant to flow from the pump through the internal passage and further through the channel of the top crankcase section.

* * * * *